US005567015A

United States Patent [19]

Arias

[11] Patent Number: 5,567,015

[45] Date of Patent: Oct. 22, 1996

[54] INFLATABLE HEADREST APPARATUS

[76] Inventor: Antonio Arias, P.O. Box 7878, Panama 9, Panama

[21] Appl. No.: 396,768

[22] Filed: Mar. 1, 1995

[51] Int. Cl.[6] ..... A47C 1/10; A47C 7/36

[52] U.S. Cl. ..... 297/397; 5/644; 5/644

[58] Field of Search ..... 297/397; 5/644, 5/633, 640

[56] References Cited

U.S. PATENT DOCUMENTS

| | | | |
|---|---|---|---|
| 682,871 | 9/1901 | Hegan et al. | 5/640 X |
| 941,043 | 11/1909 | Powell | 5/644 X |
| 1,744,364 | 1/1930 | Cruikshank . | |
| 2,557,874 | 6/1951 | Kailenta | 297/397 X |
| 2,582,571 | 1/1952 | Thoma | 297/397 |
| 2,589,155 | 3/1952 | Smith | 5/644 X |
| 2,638,152 | 5/1953 | Pulsifer . | |
| 2,765,480 | 10/1956 | Mueller | 5/640 |
| 2,952,856 | 9/1960 | Ruff | 5/644 X |
| 3,017,221 | 1/1962 | Emery | 297/397 |
| 3,307,874 | 3/1967 | Wilson . | |
| 3,795,021 | 3/1974 | Moniot | 5/644 |
| 3,897,777 | 8/1975 | Morrison | 5/644 X |
| 4,130,318 | 12/1978 | Hemmen et al. . | |
| 4,205,878 | 6/1980 | Wooten . | |
| 4,236,264 | 11/1980 | Britznan | 5/644 X |
| 4,274,673 | 6/1981 | Kifferstein | 5/640 X |
| 4,383,713 | 5/1983 | Roston | 297/397 X |
| 4,440,443 | 4/1984 | Nordskog | 297/397 |
| 4,550,458 | 11/1985 | Fiore | 5/640 X |
| 4,619,483 | 10/1986 | Dickey et al. . | |
| 4,679,263 | 7/1987 | Honer | 5/640 |
| 5,240,330 | 8/1993 | Thompson | 297/397 X |
| 5,345,633 | 9/1994 | Harnish | 5/640 X |
| 5,383,711 | 1/1995 | Houghteling | 297/397 |

FOREIGN PATENT DOCUMENTS

| | | | |
|---|---|---|---|
| 258350 | 9/1926 | United Kingdom | 297/397 |
| 385441 | 12/1932 | United Kingdom | 297/397 |
| 1411528 | 10/1975 | United Kingdom | 297/397 |
| 2194883 | 3/1988 | United Kingdom | 5/644 |

OTHER PUBLICATIONS

Packaging of Deluxe Arm Bands of Intex Recreation Corp., Long Beach, CA 90801 1993.

*Primary Examiner*—Peter M. Cuomo
*Assistant Examiner*—Rodney B. White
*Attorney, Agent, or Firm*—Oltman and Flynn

[57] ABSTRACT

A headrest apparatus for securing to a seat having a back rest, the back rest having an upper end and a front face and a rear face includes a flexible sheet member for wrapping over the upper end and having a sheet member first end for extending down the rear face of the back rest and a sheet member second end for extending down the front face of the back rest, a pair of lateral head support cushion members secured to the sheet member second end and laterally spaced apart from each other a sufficient distance to receive between them the head of a user for comfortably retaining the head against lateral sliding and rotation, and a mechanism for securing the apparatus to the back rest. The cushion members preferably include inflatable sacks having inflation and deflation mechanisms. The inflation and deflation mechanisms preferably include a tube having a tube opening and a removable tube cap for receiving air delivered by a user exhaling to inflate the sack, and for releasing air for deflating the sack, and a check valve for additionally safeguarding against unwanted air escape through the tube. The mechanism for securing the apparatus to the back rest preferably secures the apparatus removably. The mechanism for securing preferably includes belts for wrapping around a portion of the back rest, a buckle for removably securing the belts tightly around the portion of the back rest.

6 Claims, 2 Drawing Sheets

INFLATABLE HEADREST APPARATUS

BACKGROUND OF THE INVENTION

1. Field of the Invention

The present invention relates generally to the field of head supporting and cushioning devices for back rests of seats. More specifically, the present invention relates to an after-market headrest apparatus for removable attachment to the upper end of a high back rest. The apparatus includes a flexible sheet member having a sheet member first end for wrapping over the upper end of a back rest and a sheet member second end for extending down the front of the back rest for a user to rest his or her head against. A pair of lateral support cushion members are secured to the exposed face of the sheet member second end. These cushion members are spaced apart from each other a sufficient distance to receive between them the head of a user., to retain the head against lateral movement and rotation. The cushion members are preferably inflatable sacks, each including a flexible air passing tube with a capped tube opening and containing a check valve which is opened by squeezing the sides of the tube. The surface of each sack around the tube is preferably constructed to deform with pressure against the protruding tube end to collapse into the sack and form a small pocket into which the tube is retracted during apparatus use.

The user uncaps the tube opening of one sack and blows air into it until the sack is inflated, caps the opening and then presses against the protruding end of the tube to cause the tube to retract into the small pocket to be substantially flush with the adjacent sack surface. Then the user similarly inflates the other sack. The user may deflate the sacks by simply pulling the tubes out from the sacks, uncapping the tubes, and squeezing the tubes to open the valves in the tubes and release the contained air.

The apparatus is removably secured to a back rest with first and second pairs of connecting belts. The first pair of belts extends from opposing lateral edges of the sheet member first end to engage the second pair of belts which extend from opposing lateral edges of the sheet member second end. The first; and second belts are joined and pulled tightly together around either side of the back seat through buckles. The sheet member is preferably a section of blanket material and the inflatable sacks are preferably formed of rubber.

2. Description of the Art

There have long been cushion and pillow devices for retaining the head of a person sitting in a seat against rotation and lateral sliding.

One such device is that of Cruickshank, U.S. Pat. No. 1,744,364, issued on Jan. 21, 1930. Cruickshank discloses a headrest including a padded, U-shaped head support frame which rides in a track member. The track member is curved to fit snugly over the top of a back rest. A set screw on the track member adjacent the rear face of the back rest presses a bracket against the rear face. The bracket includes a pair of anchoring prongs which penetrate the rear face of the back rest. The track member permits height adjustment of the head support frame to accommodate various user heights. A problem with Cruickshank is that the head support frame is very restrictive of head movement. Another problem is that comfort is minimal because the head does not sink into the back rest cushion. Instead, the head is held forward awkwardly by the headrest structure, which protrudes forwardly of the back rest front face. Still another problem is that the penetrating anchor prongs may well damage the seat to which Cruickshank is secured. Finally, the rigid frame members of Cruickshank cannot collapse into a smaller area for compact storage and carrying in a handbag.

Pulsifer, U.S. Pat. No. 2,638,152, issued on May 12, 1953, reveals a single side headrest. Pulsifer includes a back rest clamp structure which fits over the top of a back rest, including rear, top and front clamp members. The rear clamp member has a set screw which extends into a longitudinal track slot in the top clamp member. The structure is fitted over the top of a back rest, and the rear clamp member is advanced toward the front clamp member along the track until the back rest is gripped between them. Then the set screw is tightened to hold the apparatus in place. A head support arm extends forwardly from the front clamp member and has a lateral pad oriented toward the adjacent side of the user head for lateral head support. A problem with Pulsifer is that only one side of the head is supported, which may be inadequate for random head movement during sleep, such as on an extended train or bus ride. Another problem is that the rigid Pulsifer frame could injure a sleeping user if his or her face were to slide against it.

Wilson, U.S. Pat. No. 3,307,874, issued on Mar. 7, 1967, teaches another headrest design. A head supporting cushion is rotatably mounted on an upright stem member which extends into the top of a back rest. The lower end of the stem member has a side surface including a longitudinal series of undulations. The stem member is mounted to slide longitudinally so that the side surface undulations ride against a spring-loaded ball, which releasably holds the stem member at one of several possible extension positions for accommodating various user heights. The stem member passes through a port in a flange plate secured to the top of the back rest. A problem with Wilson is that the seat must be substantially and permanently altered to receive the Wilson headrest apparatus. Such alteration would not be possible for a bus, train or airplane passenger to accomplish. Other problems with Wilson are that the apparatus is complicated, costly and bulky, and does not appear to provide side support for the user head.

Hemmen, et al., U.S. Pat. No. 4,130,318, issued on Dec. 19, 1978, reveals a headrest with side pads for mounting on a seat. Hemmen includes a lateral pad mounted on a support assembly which is integral with a side portion of a seat and is attached to the back of the seat. The support assembly includes a support stem and the lateral pad is mounted on the stem. A ratcheting mechanism is provided to permit incremental longitudinal movement of the stem to adjust the height of the pad. The lateral pad is rotatably mounted on the stem. Hemmen, et al., is complex, costly, bulky and not suited to convenient passenger attachment to a bus or train seat.

Wooten, U.S. Pat. No. 4,205,878, issued on Jun. 3, 1980, discloses a pull-out headrest assembly. An extended back rest is provided having an upper end and a front face. A passageway is recessed into the front face on either side of the upper end, and a lateral headrest cushion rides out of each passageway on a guide rail. These headrest cushions retain between them the head of a seat user. A problem with Wooten is that the passageways and headrest cushions must be manufactured with the seat, or the seat must be substantially and permanently modified. Thus Wooten is of no help to a patron of public transportation, unless the particular municipality happens to order buses and trains which are so equipped.

Dickey, et al., U.S. Pat. No. 4,619,483, issued on Oct. 28, 1986, teaches a shoulder support apparatus for attachment to a chair for use by the physically handicapped. A seat side panel having inwardly directed cushions is secured to the side of the chair just above an arm rest. An elongate hook member fits over the top of the back rest and into an upright holding tube attached to the rear face the back rest. Left and right hand side panels may be provided to retain the chair user on both seat sides. A problem with Dickey, et al., is that the side panels are too large and cumbersome for convenient carrying to and from buses and trains. Another problem is that the holding tubes must somehow be removably attached to the rear face of the back rest. Finally, Dickey, et al. would be expensive to manufacture.

It is thus an object of the present invention to provide a lateral headrest apparatus which can be quickly and removably fit to any of a variety of high back seats, such as those on public buses, trains, airplanes, automobiles, and those in airports and in bus and train terminals, to retain the head of a sleeping seat occupant against lateral sliding and rotation.

It is another object of the present invention to provide such an apparatus which does not damage the seat to which it is attached.

It is still another object of the present invention to provide such an apparatus which is light weight, soft and very compact for convenient carrying inside hand bags, brief cases and so forth, to and from various seat locations.

It is finally an object of the present invention to provide such an apparatus which is safe, reliable and inexpensive to manufacture.

SUMMARY OF THE INVENTION

The present invention accomplishes the above-stated objectives, as well as others, as may be determined by a fair reading and interpretation of the entire specification.

A headrest apparatus is provided for securing to a seat having a back rest, the back rest having an upper end and a front face and a rear face, including a flexible sheet member for wrapping over the upper end and having a sheet member first end for extending down the rear face of the back rest and a sheet member second end for extending down the front face of the back rest, a pair of lateral head support cushion members secured to the sheet member second end and laterally spaced apart from each other a sufficient distance to receive between them the head of a user for comfortably retaining the head against lateral sliding and rotation, and a mechanism for securing the apparatus to the back rest. The cushion members preferably include inflatable sacks having inflation and deflation mechanisms. The inflation and deflation mechanisms preferably include a tube having a tube opening and a removable tube cap for receiving air delivered by a user exhaling to inflate the sack, and for releasing air for deflating the sack. A check valve is preferably provided for each tube from which air is released by squeezing the sides of the tube toward each other. The mechanism for securing the apparatus to the back rest preferably secures the apparatus removably. The mechanism for securing preferably includes belts for wrapping around a portion of the back rest, a buckle for removably securing the belts tightly around the portion of the back rest. The belts preferably include first and second pairs of connecting belts, the first pair of belts extending from opposing lateral edges of the sheet member first end for engaging the second pair of belts which extend from opposing lateral edges of the sheet member second end, and a belt engaging mechanism for securing together the first and second pairs of connecting belts.

A headrest apparatus is also provided, including a seat having a back rest, the back rest having an upper end and a front face and a rear face, a flexible sheet member for wrapping over the upper end and having a sheet member first end for extending down the rear face of the back rest and a sheet member second end for extending down the front face of the back rest, a pair of lateral head support cushion members secured to the sheet member and spaced apart from each other a sufficient distance to receive between them the head of a user for comfortably retaining the head against lateral movement and rotation, and a mechanism for securing the sheet member to the back rest.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
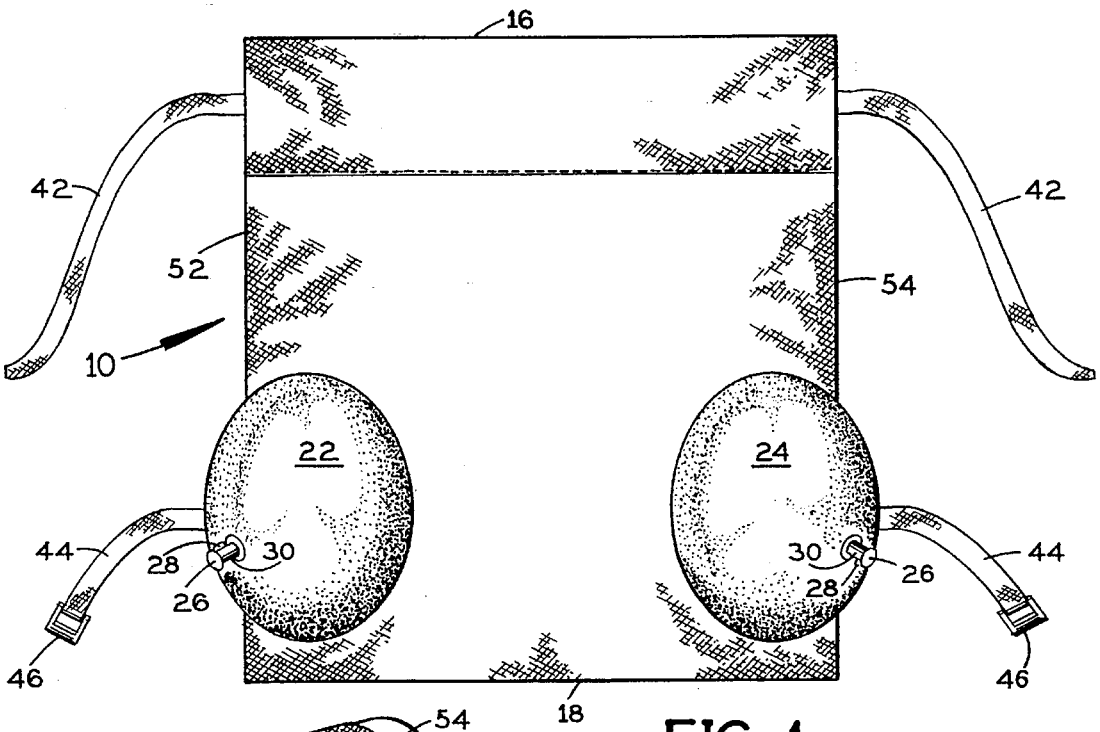
FIG. 1 is a view of the inventive apparatus, excluding the optional arm straps.
Figure 2:
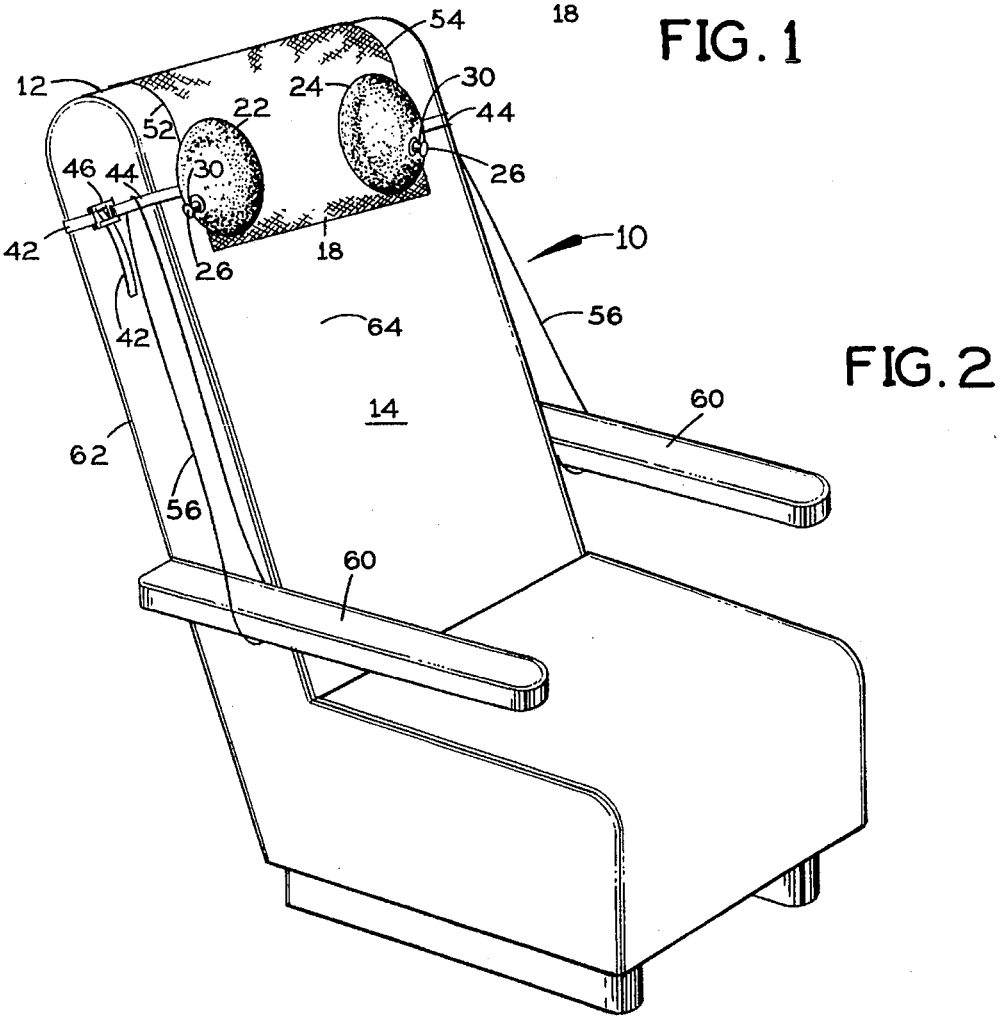
FIG. 2 is a perspective view of the upper part of a high back chair or seat with the apparatus installed, and showing the optional arm straps.
Figure 3:
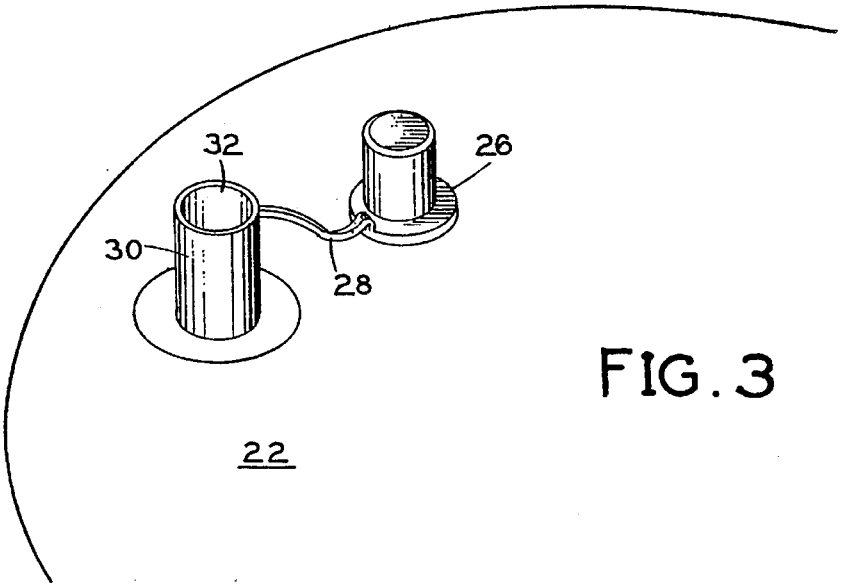
FIG. 3 is a close-up perspective view of one of the inflatable cushions showing the air passing tube and the tube cap.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

PREFERRED EMBODIMENTS

Referring to FIGS. 1–5, a headrest apparatus 10 is disclosed for removable attachment to the upper end 12 of a seat back rest 14. Back rest 14 must be of sufficient height to extend behind and support the head of a user. Apparatus 10 includes a flexible sheet member 20 for wrapping over upper end 12 of a back rest 14 and having a sheet member first end 16 for extending down the rear face of back rest 14 and a sheet member second end 18 for extending down the front face of back rest 14. See FIGS. 1 and 2. A pair of lateral support cushion members 22 and 24 are secured to sheet member second end 18 and are laterally spaced apart from each other a sufficient distance to closely receive between them the head of a user to comfortably retain the head against lateral movement and rotation.

Figure 4:
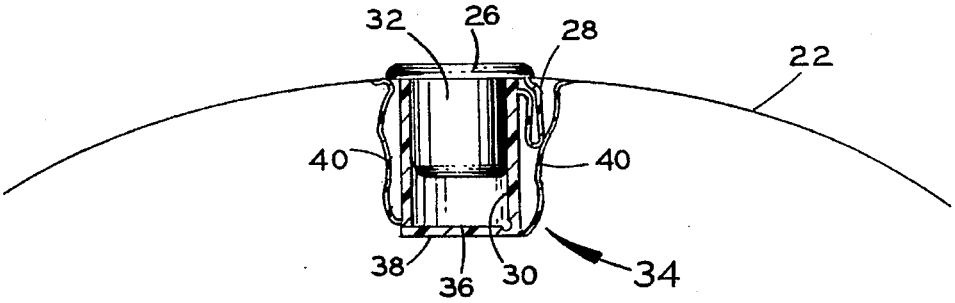
FIG. 4 is a cross-sectional side view of a cushion tube revealing the preferred trap door check valve construction, with the check valve closed. The tube is shown retracted into the optional depression or small pocket in the wall of the inflatable cushion, which has no effect on the check valve operation.
Figure 5:
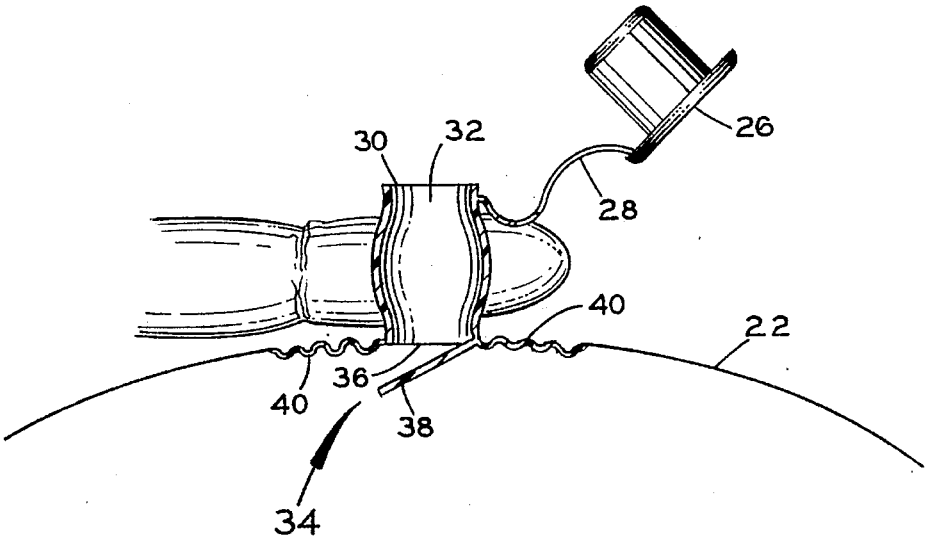
FIG. 5 is a view as in FIG. 4, except that the tube is shown withdrawn from the small pocket and extended, and the tube walls are shown squeezed so that the check valve is opened.

Cushion members 22 and 24 are preferably inflatable sacks, each having a flexible air passing tube 30 extending therefrom with a cap 26 on a connecting cord 28 for sealing the tube opening 32. See FIG. 3. Each tube 30 preferably includes a check valve 34 as shown in FIGS. 4 and 5. Valves 34 each preferably include a tube bottom wall 36 which is separated from the tube along a portion of its circumference to create a resilient trap door 38. The resilience of the bottom wall 36 material holds trap door 38 closed, and the pressure of the contained air against trap door 38 additionally presses trap door 38 into a sealing relationship with tube 30. The surface of each cushion member 22 and 24 around each tube 30 is preferably constructed by known methods to deform with pressure against the protruding tube end to collapse into the cushion member 22 or 24 and form a small pocket 40 into which the tube 30 retracts during apparatus use. See FIG. 4.

To inflate cushion members 22 and 24, the user uncaps an opening 32 of one cushion member tube 30 and blows air into tube 30 until the cushion member 22 or 24 is fully inflated. The trap door 38 flexes inwardly with the blown air pressure to admit the blown air into the cushion member 22 or 24. The user then returns cap 26 to the opening 32 and similarly inflates the other cushion member 24 or 22, and presses tubes 30 into the small pockets 40. To deflate cushion members 22 and 24, the user simply pulls the tubes 30 out from the recess pockets 40, uncaps tubes 30, and squeezes opposing sides of each tube 30 toward each other to open each valve 34 and to thereby release the air contained in each cushion member 22 and 24.

Alternatively, tubes 30 are connected to a compressed air source (not shown) and air is delivered into cushion members 22 and 24 through openings 32. Other types of valves 34 may be provided which, for example, may be operated by pulling a cord such as on some commercial airline life vests.

Apparatus 10 is preferably removably secured to a back rest 14 with first and second pairs of connecting belts 42 and 44, respectively. The first pair of belts 42 extend from opposing lateral edges 52 and 54 of sheet member first end 16 to engage the second pair of belts 44 which extend from opposing lateral edges 52 and 54 of sheet member second end 18. These first and second pairs of belts 42 and 44 are joined and pulled tightly together on either side of the back rest 14 through a buckle 46. Belts 42 and 44 equivalently include hook and loop fastener patches, latches or other fastener means in place of buckle 46. Belts 42 and 44 alternatively may be simply tied together. Arm straps 56 are optionally provided which extend from belts 42 and 44 around the nearest seat arm 60 for added apparatus 10 engagement.

Sheet member 20 is preferably a section of blanket material. The portion of sheet member first end 16 extending down the rear face 62 of back rest 14 is generally shorter than the portion of sheet member second end 18 extending down the front face 64 of back rest 14. Therefore, for counterbalance, the thickness of sheet member first end 16 is preferably made greater than the thickness of sheet member second end 18, such as by folding or otherwise double-layering. Cushion members 22 and 24 are preferably formed of rubber or an equivalent flexible and stretchable material.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A headrest apparatus for use with a seat having a backrest with an upper end, a rear face, a front face, a left seat arm and a second seat arm, the headrest apparatus, comprising:

a flexible sheet member formed from a blanket material for wrapping over said upper end having a sheet member first end having a first length and a first thickness for extending down said rear face of said back rest and a sheet member second end having a second length and a second thickness for extending down said front face of said back rest, the first length of the sheet member first length being shorter than the second length of the sheet member second length, and the first thickness of the sheet member first end being thicker than the second thickness of the sheet member second thickness, a pair of lateral head support cushion members, each of the head support cushion members having an inflatable sack and valve means for separately inflating and deflating each inflatable sack, each head support cushion secured to said sheet member and spaced apart from each other a sufficient distance to receive between them the head of a user on the sheet member, for comfortably retaining said head against lateral movement and rotation, means for securing said sheet member to said back rest, a first pair of belt means for securing a left side of the sheet member first end to a left side of the sheet member second end, a second pair of belt means for securing a right side of the sheet member first end to a right side of the sheet member second end, a first strap means for securing the first pair of belt means to the left seat arm, and a second strap means for securing the second pair of belt means to the right seat arm.

2. An apparatus according to claim 1, wherein each pair of said valve means comprise:

a tube having a tube opening and a removable tube cap for receiving air delivered by a user exhaling to inflate said sack, and for releasing air for deflating said sack.

3. An apparatus according to claim 2, wherein each said tube additionally comprises:

check valve means for preventing air from escaping from said cushion members through said tubes until said check valve means are opened.

4. An apparatus according to claim 1, further comprising:

first buckle means for removably securing said first pair of belt means tightly around said portion of said back rest; and second buckle means for removably securing said second pair of belt means tightly around said portion of said back rest.

5. A headrest apparatus for use with adult seats having a backrest with an upper end, a rear face, a front face, a left seat arm and a second seat arm, the headrest apparatus, comprising:

a flexible sheet member formed from a blanket material for wrapping over said upper end of the backrest, having a sheet member first end having a first length and a first thickness for extending down said rear face of said back rest and a sheet member second end having a second length and a second thickness for extending down said front face of said back rest,, the first length of the sheet member first length being shorter than the second length of the sheet member second length, and the first thickness of all the sheet member first end being thicker than the second thickness of all the sheet member Second thickness, a pair of lateral head support cushion members, each of the head support cushion members having an inflatable sack and valve means for separately inflating and deflating each inflatable sack, each head support cushion secured to said sheet member and spaced apart from each other a sufficient distance to receive between them the head of a user on the sheet member:, for comfortably retaining said head against lateral movement and rotation, means for securing said sheet member to said back rest, a first pair of belt means and a first buckle means for securing a left side of the sheet member first end to a left side of the sheet member second end, a second pair of belt means and a second buckle means for securing a right side of the sheet member first end to a right side of the sheet member second end.

6. A headrest apparatus for use with a seat having a backrest with an upper end, a rear face, a front face, a left seat arm and a second seat arm, the headrest apparatus, comprising:

a flexible sheet member formed from a blanket material for wrapping over said upper end having a sheet member first end for extending down said rear face of said back rest and a sheet member second end for extending down said front face of said back rest, a pair of lateral head support cushion members, each of the head support cushion members having an inflatable sack and valve means for separately inflating and deflating each inflatable sack, each head support cushion secured to said sheet member and spaced apart from each other a sufficient distance to receive between them the head of a user on the sheet member, for comfortably retaining said head against lateral movement and rotation, means for securing said sheet member to said back rest, a first pair of belt means for securing a left side of the sheet member first end to a left side of the sheet member second end, and a second pair of belt means for securing a right side of the sheet member first end to a right side of the sheet member second end.

* * * * *